US010760297B2

(12) United States Patent
Shin

(10) Patent No.: US 10,760,297 B2
(45) Date of Patent: Sep. 1, 2020

(54) TENT

(71) Applicant: Liveplex Co., Ltd., Seoul (KR)

(72) Inventor: Dong Il Shin, Seoul (KR)

(73) Assignee: LIVEPLEX CO., LTD., Seoul (KR)

( * ) Notice: Subject to any disclaimer, the term of this patent is extended or adjusted under 35 U.S.C. 154(b) by 0 days.

(21) Appl. No.: 16/016,858

(22) Filed: Jun. 25, 2018

(65) Prior Publication Data

US 2019/0292807 A1 Sep. 26, 2019

(30) Foreign Application Priority Data

Mar. 22, 2018 (KR) ..... 20-2018-0001240 U

(51) Int. Cl.

| | |
|---|---|
| ***E04H 15/26*** | (2006.01) |
| ***E04H 15/60*** | (2006.01) |
| ***E04H 15/16*** | (2006.01) |
| *E04H 15/24* | (2006.01) |

(52) U.S. Cl.

CPC ..... *E04H 15/26* (2013.01); *E04H 15/16* (2013.01); *E04H 15/60* (2013.01); *E04H 15/24* (2013.01)

(58) Field of Classification Search

CPC ..... E04H 15/24

See application file for complete search history.

(56) References Cited

U.S. PATENT DOCUMENTS

| | | | | |
|---|---|---|---|---|
| 3,043,320 | A * | 7/1962 | Moss | E04H 15/16 135/121 |
| 4,078,572 | A * | 3/1978 | Moss | E04H 15/18 135/118 |
| 4,537,210 | A * | 8/1985 | Montgomery | E04H 15/003 135/115 |
| 4,882,884 | A * | 11/1989 | Browne | E04H 15/18 52/82 |
| 5,477,876 | A * | 12/1995 | Moss | E04H 15/26 135/100 |
| 6,021,796 | A * | 2/2000 | Vavra | E04H 15/16 135/121 |
| 6,354,317 | B1 * | 3/2002 | Lah | E04H 15/425 135/118 |
| 7,841,356 | B2 * | 11/2010 | Shires | E04H 15/42 135/119 |
| 8,684,020 | B1 * | 4/2014 | Shires | E04H 15/00 135/123 |
| 2013/0061898 | A1 * | 3/2013 | Webster | E04H 15/008 135/156 |

FOREIGN PATENT DOCUMENTS

| | | | | |
|---|---|---|---|---|
| GB | 193597 | A * | 3/1923 | E04H 15/26 |
| GB | 1603210 | A * | 11/1981 | E04H 15/40 |
| KR | 20-2013-0002273 | | 4/2013 | |

* cited by examiner

*Primary Examiner* — David R Dunn

*Assistant Examiner* — Danielle Jackson

(74) *Attorney, Agent, or Firm* — Kile Park Reed & Houtteman PLLC

(57) ABSTRACT

A tent including a sheet 100 forming an inner space S having two peaks P1, P2 and a supporting pole assembly 200 including a main pole member 210 installed upward in the inner space S and a pair of branch pole members 220, 230 branched from the main pole member 210 to support the sheet 100, thereby forming the two peaks P1, P2, is disclosed.

6 Claims, 8 Drawing Sheets

TENT

TECHNICAL FIELD

The present invention disclosed herein relates to a tent, and more particularly, to a tent capable of enhancing inner space utilization.

BACKGROUND ART

A Teepee tent is manufactured based on the model of a Teepee used at a campsite for a tribe having culture of hunting while moving between southern Canada and the plains and northwest North America. The Teepee tent requires only a few components and a relatively simple structure makes installation of the Teepee tent easy.

The Teepee tent may be manufactured from a small sized tent to an extremely large sized tent for accommodating several households and have a shape in which a large stick stands at a central portion of the tent and fabric covers from the ground by using the stick as a supporting pole.

Accordingly, the Teepee tent may excellently keep the inside of the tent warm because the Teepee tent withstands strong wind blown outside, and a fire can be made inside.

However, since the pole stands in the central portion of the tent, an inner space of the Teepee tent remarkably decreases towards an upper portion of the tent, and thus substantial usable inner space of the tent is reduced.

Korean Publication Utility Model No. 2013-0002273 discloses a feature of adding a frame at an upper end portion of the tent to solve the above-described limitation. However, such a structure has a limitation in that easy installation and simple structure, which are inherent advantages of the Teepee tent, cannot be achieved.

Also, since additional frames are necessary, the tent increases in weight and volume, and costs of the tent also increase.

DISCLOSURE OF THE INVENTION

Technical Problem

The present invention provides a tent capable of maximizing usable inner space to solve the above-described limitations.

Technical Solution

In accordance with an embodiment of the present invention, there is provided a tent which includes: a sheet 100 forming an inner space S having two peaks P1, P2; and a supporting pole assembly 200 including a main pole member 210 installed upward in the inner space S and a pair of branch pole members 220, 230 branched from the main pole member 210 to support the sheet 100, thereby forming the two peaks P1, P2.

The sheet 100 may include a fixing-coupling means 300 for forming the outer shape of the tent, and the fixing-coupling means 300 may be connected with a fixing structure installed at the outside of the tent and a vertex of a polygonal planar shape may be formed by the lower end of the sheet 100.

The tent may further include a plurality of connecting units 400 having one end coupled to the sheet 100 and the other end coupled to the fixing-coupling means 300 between the peaks P1, P2 and the fixing-coupling means 300 to form a triangular shape together with the sheet 100 and the fixing-coupling means 300.

A frame member 410 may be further installed in perpendicular to the ground between a position at which the connecting unit 400 is connected to the sheet 100 and a position coupled to the fixing-coupling means 300.

The sheet 100 may include at least one venting opening 110 for ventilating the inner space S of the tent, and each peak P1, P2 may be positioned at the edge of the venting opening 110.

The tent may further include a cover member 120 for covering the venting opening 110.

The supporting pole assembly 200 may include a connector 240 for connecting the main pole member 210 to the pair of the pole members 220, 230.

Advantageous Effects

As the sheet of the tent is used to form the inner space having two peaks, the tent in accordance with the present invention may form the inner space greater than that of a conventional tent having a single peak having the same bottom area, thereby maximizing the space utilization efficiency.

In particular, as a pair of branch pole members branched from the upper end of one main pole member is formed when the two peaks are formed in the inner space, the tent in accordance with the present invention may have the bottom space near the lower end that has the same space as that of a conventional Teepee tent and overcome the limitation in which the space remarkably decreases towards the upper end of the tent, thereby efficiently utilizing the space.

Also, without additional cost by adding components such as the frame to increase the conventional utilization space, and the reduction in portability, as the tent has the simple configuration including the main pole member and a pair of branch pole members, the tent in accordance with the present invention may have no additional costs, is easily carried out, and is simply installed.

Also, the tent in accordance with the present invention may use the Y-shaped supporting pole assembly to support the sheet of the tent while forming the two peaks, thereby improving the stability when the tent is installed by applying the predetermined tension between the two peaks.

MODE FOR CARRYING OUT THE INVENTION

Figure 1:
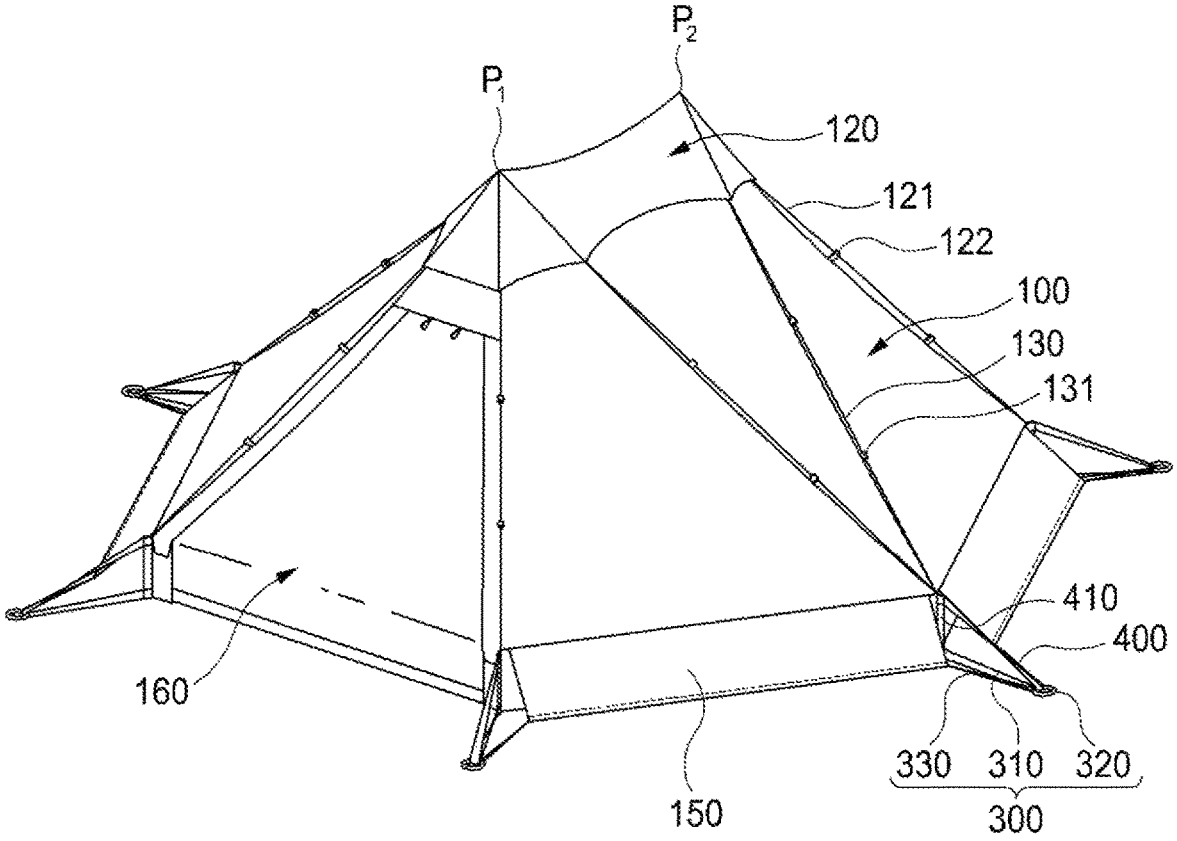
FIG. 1 is a perspective view of a tent in accordance with the present invention.
Figure 2:
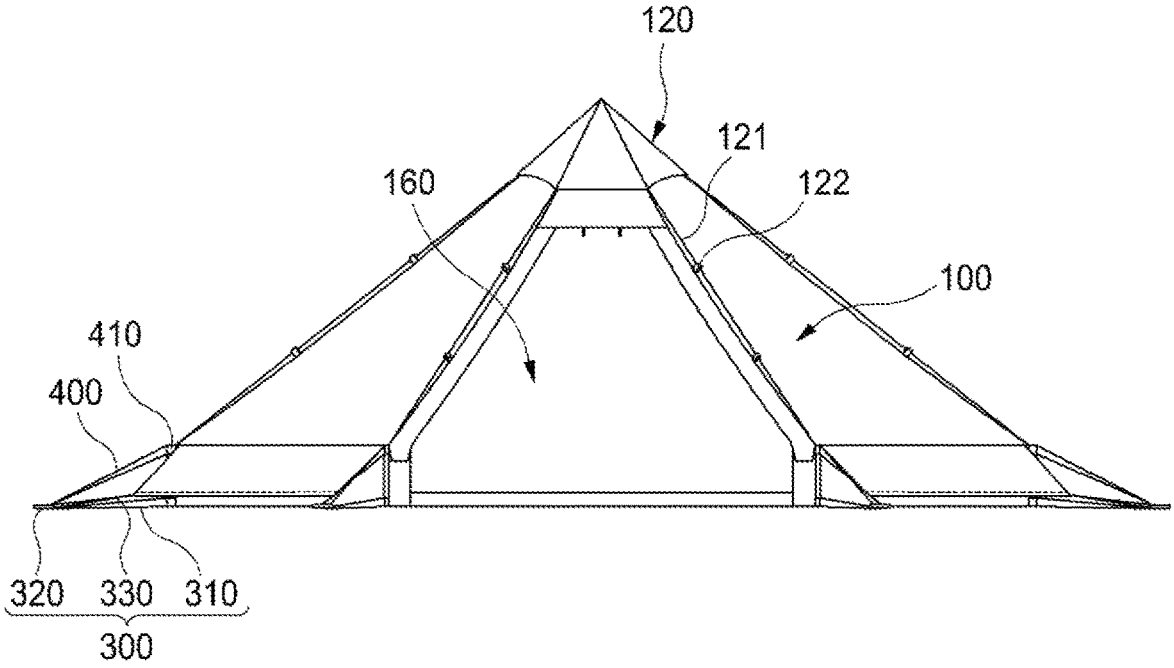
FIG. 2 is a front view illustrating a front surface of the tent of FIG. 1.
Figure 3:
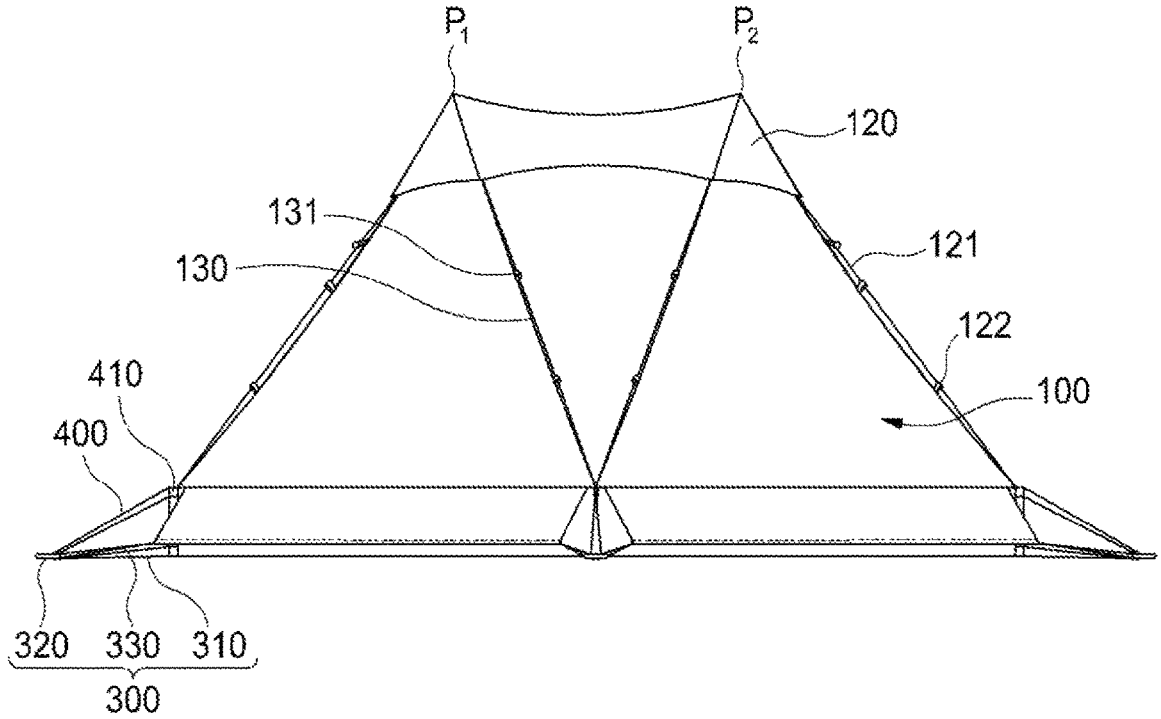
FIG. 3 is a side view illustrating a side surface of the tent of FIG. 1.
Figure 4:
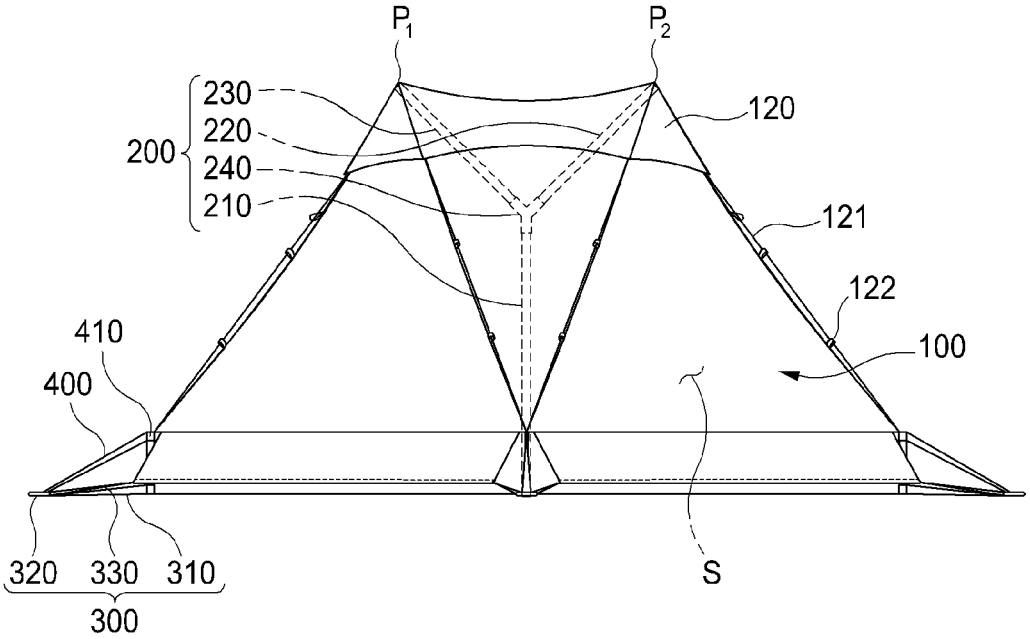
FIG. 4 is a side projected view illustrating a state in which a supporting pole assembly is installed in the tent of FIG. 1.
Figure 5:
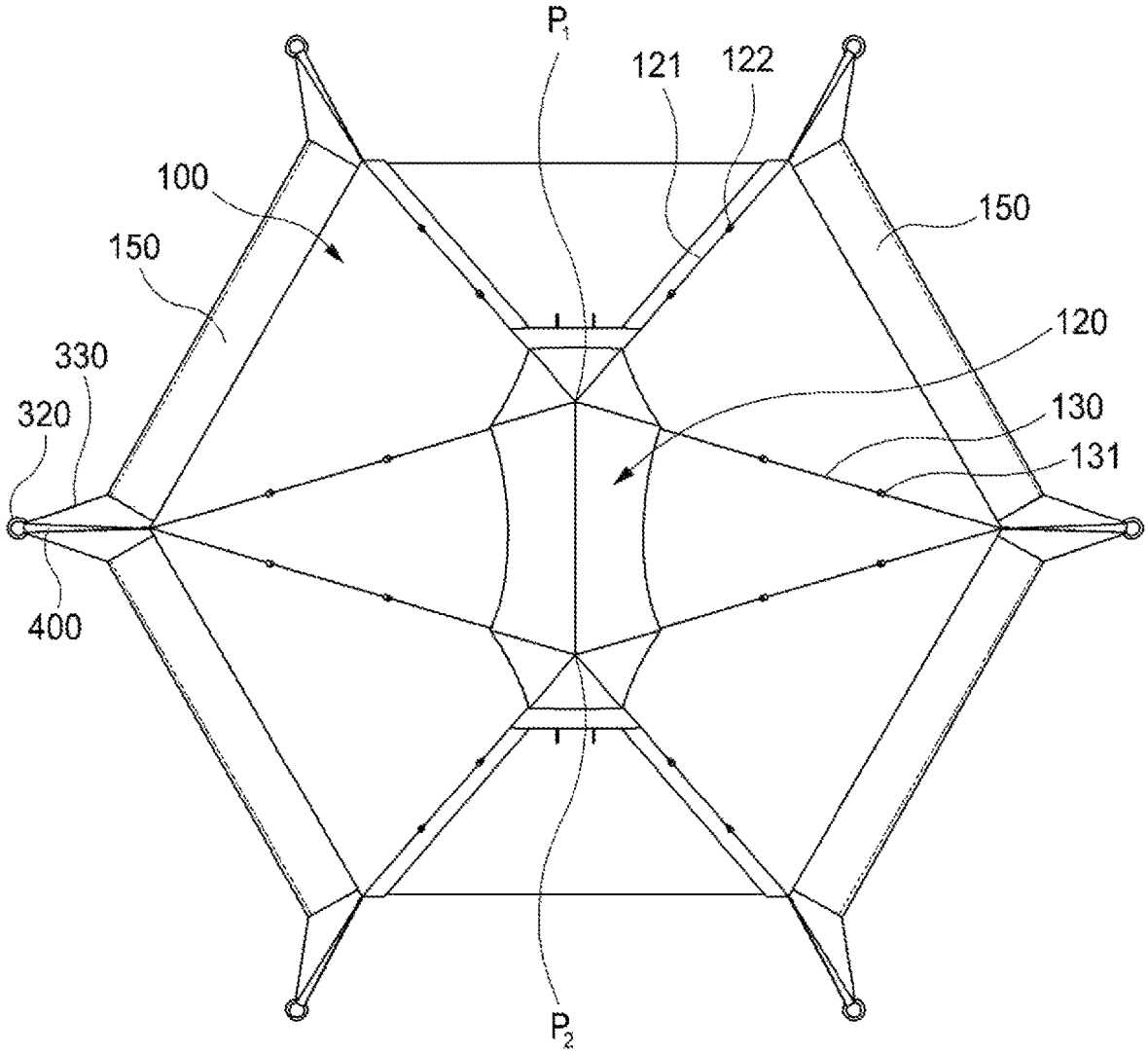
FIG. 5 is a plan view illustrating the tent of FIG. 1.
Figure 6:
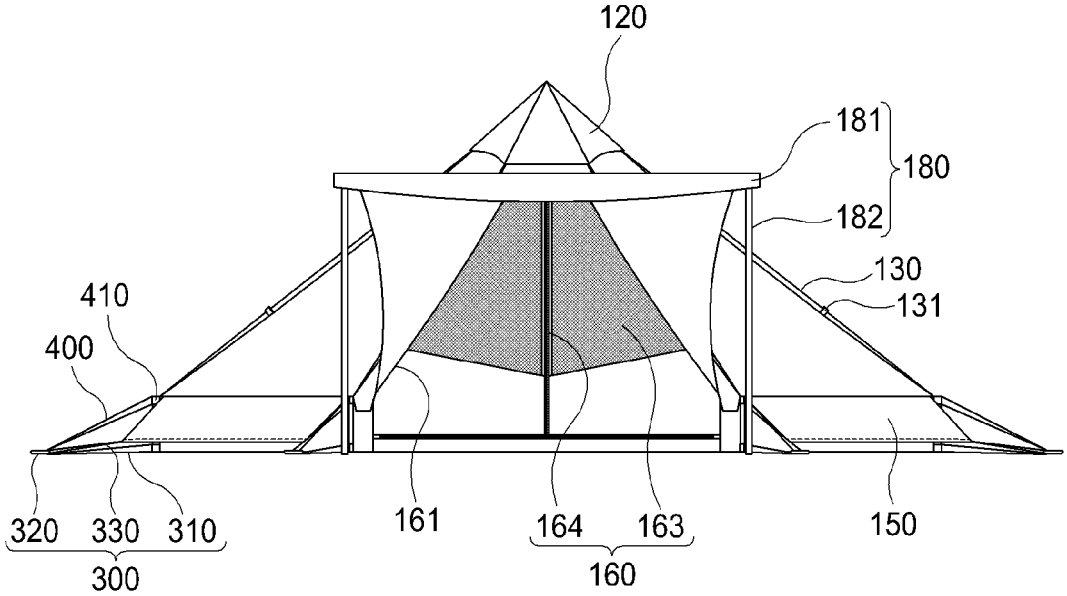
FIG. 6 is a front view illustrating an entrance and a light shielding part as one embodiment of the tent of FIG. 1.
Figure 7:
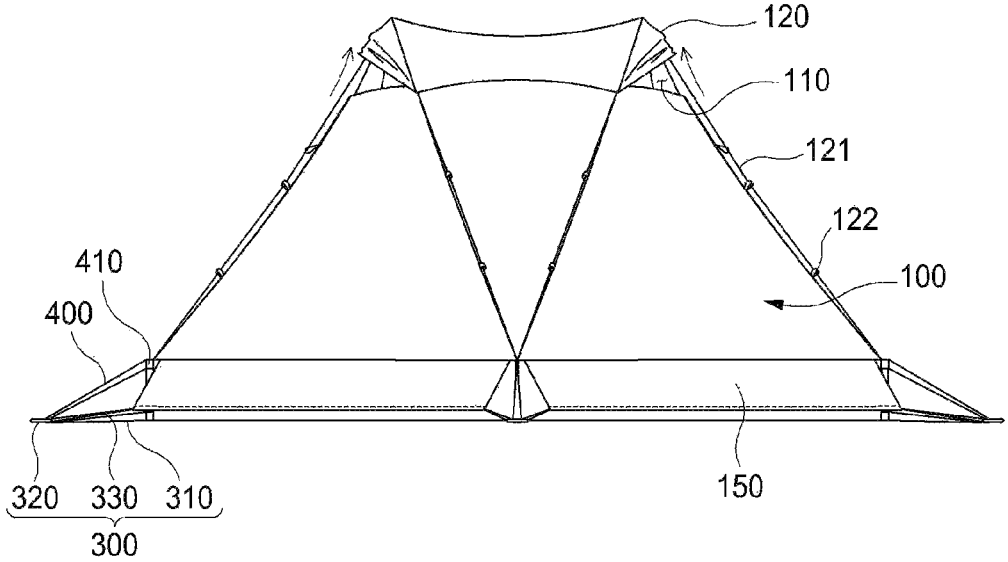
FIG. 7 is a side view illustrating a state in which a venting opening is opened to ventilate an inside of the tent of FIG. 1.

Hereinafter, a tent in accordance with the present invention will be described in detail with the accompanying drawings as stated below.

As illustrated in FIGS. 1 to 7, the tent in accordance with the present invention includes: a sheet 100 that forms an inner space S having two peaks P1, P2; and a supporting pole assembly 200 including a main pole member 210 installed upward in the inner space S and a pair of branch pole members 220, 230 that form the two peaks P1, P2.

The sheet 100 forms the inner space S having the two peaks P1, P2. Particularly, the sheet 100 is supported by the supporting pole assembly 200 so as to form the inner space S in which a user may live and may have various configuration in accordance with an entire shape and structure of the tent.

The sheet 100 forms a ceiling and a wall of the tent. In particular, as the sheet 100 is supported by the supporting pole assembly 200, the sheet 100 may form the entire shape of the tent and form ceiling and wall of the tent after complete set up of the tent.

Furthermore, the sheet 100 may additionally form a bottom of the tent. In this case, as the supporting pole assembly 200 is installed between the bottom and the ceiling to support the sheet 100, the sheet 100 may form the inner space S while forming the shape of the tent.

The sheet 100 may be made of various materials such as polyester and cotton, and further include waterproof materials in accordance with environment of using the tent.

The sheet 100 may include at least one venting opening 110 for ventilating the inner space S of the tent. And the peaks P1, P2 may be positioned at the edge of the venting opening 110.

The tent in accordance with the present invention may be modified from the Teepee tent. Accordingly, it is desirable that a fire is useable, or that other heating instruments are usable in the inner space S of the tent. Accordingly, it is preferable to provide means for exhausting smoke from a fire to the outside or ventilating the inner space S, in which air circulation is necessary.

The venting opening 110 is an opening that is defined in the sheet 100 to ventilate the inner space S of the tent. More desirably, a pair of venting openings 110 may be defined respectively in positions facing each other for smooth ventilation.

In particular, the two venting openings 110 may be formed near the respective peaks P1, P2. And the peaks P1, P2 may be positioned in the respective edges of the venting openings 110.

That is, as the venting opening 110 is defined in positions adjacent to the peaks P1, P2 on a front surface and a rear surface of the tent, the pair of the venting openings 110 may face each other in a longitudinal direction of the tent, so that wind may smoothly pass through the inner space S.

A mesh net (not shown) may be installed in the venting opening 110 to prevent insects or the like from entering through the venting opening 110.

The mesh net may have a mash gap that sufficiently prevents any insect from entering, and may be made of materials such as insect-proof netting and be coupled to the sheet 100.

Since the inner light of the tent may attract insects due to a feature of the tent that is generally used for camping, the mesh net may prevent insects from entering, and more desirably, block the entrance of insects by using electricity such as violet light or high voltage.

The venting opening 110 may include at least one connecting member 111, 112 having one end coupled to a support part that will be described later and the other end coupled to an edge reinforcing part 171 for reinforcing an edge of the venting opening 110 in order to prevent entire shape and balance of the tent from being distorted as the sheet 100 below the venting opening 110 is deflected due to gravity when the venting opening 110 is formed.

The connecting member 111, 112, which is coupled to the sheet 100 while crossing the venting opening 110 to maintain the entire shape of the tent, may be variously provided.

Here, since foreign substances and cold air may be introduced into the inner space S through the venting opening 110, to block the same, the tent in accordance with the present invention may include a cover member 120 for covering the venting opening 110.

The cover member 120, which covers the venting opening 110, may be variously provided in the sheet 100.

In particular, the cover member 120 may be installed on an outer surface of the ceiling portion of the sheet to cover the venting opening 110 defined in the front surface and the rear surface of the sheet.

In more particular, in consideration that one venting opening 110 is defined by using one of the two peaks P1, P2, the cover member 120 may cover all the two peaks P1, P2 and, at the same time, extend downward from the two peaks P1, P2 to cover all of the two venting openings 110 that have various shapes such as a polygonal shape.

That is, the cover member 120 may be installed to cover a portion of the sheet 100, which extends downward from the ceiling of the sheet 100 forming the two peaks P1, P2.

The cover member 120 may include at least one fixing rope 121 for fixing the cover member 120 to the sheet 100 and at least one fastening part 122 that is installed on the sheet 100 to fasten the fixing rope 121 in order to prevent the cover member 120 from being separated by a tension of the fixing rope 121.

The fixing rope 121 for fixing the cover member 120 to the sheet 100, may be variously provided with. For example, the fixing rope 121 may have one end coupled to a lower end of the cover member 120 and the other end fastened to the fastening part 122 installed on the sheet 100 and be symmetric with respect to a line connecting the pair of peaks P1, P2 to prevent the cover member 120 from being separated.

Also, the fixing rope 121 may have one end coupled to an inner surface of the cover member 120 at the venting opening 110 to simply maintain opened state of the venting opening 110, thereby maintaining an uncovered state of the cover member 120 at the venting opening 110.

The fixing rope 121 may include a fastening member (not shown) corresponding to the fastening part 122 so that both ends thereof may be easily fixed to the fastening part 122 and the fastening part 122 disposed on the cover member 120.

The fastening parts 122, which are coupled to the sheet 100 and the cover member 120 so that the fixing rope 121 is installed, may be spaced apart from each other so that the fixing rope 121 is installed by a predetermined length and with a predetermined tension.

The fastening member may have a shape corresponding to the fastening part 122 so that the fastening member is coupled to each end of the fixing rope 121, and thus the fixing rope 121 is easily coupled to the fastening part 122.

For example, the fastening member may be a ring-shaped member coupled to the circular fastening part 122. The fastening member may be fastened to the fastening part 122 such that a gap, which is for fastening, is extended by pressing of the user.

However, since the cover member 120 is installed on the outer surface of the ceiling portion of the sheet 100, it is difficult to open the cover member 120 by uncovering the cover member 120 at the venting opening 110 due to the great height of the cover member 120.

To solve the above-described limitation, the fixing rope 121 fastened to the fastening part 122 may be used to uncover a portion of the cover member 120, thereby opening the venting opening 110. In particular, the venting opening 110 may be opened by pulling the fixing rope 121 installed on the inner surface of the cover member 120 at the front side in a direction from the front surface to the rear surface, and the fixing rope 121 pulled to the rear surface may be fastened to the fastening part 122 installed on the sheet 100 disposed on the rear surface of the tent to maintain the uncovered state of the cover member 120.

As described above, the venting opening 110 may be opened, and, by reversing the order of the process described above, the venting opening formed in the rear surface may be opened by pulling and fixing the fixing rope 121, and the opened state of the venting opening 110 may be maintained.

The sheet 100 may include: a connecting rope 130 connecting a position corresponding to a vertex of the polygonal shape to the peaks P1, P2 to form the edge of the tent; and a plurality of connecting rope fastening parts 131 coupled to the sheet 100 to couple the connecting rope 130 to the sheet 100 so that the lower end of the tent has a polygonal shape, e.g., a hexagonal shape.

For example, the plurality of connecting rope fastening parts 131 may be spaced a predetermined distance from each other on an imaginary line connecting the peaks P1, P2 to the vertices of the polygonal shape that is a planar shape of the lower end of the tent, and the connecting rope 130 may be fastened to the connecting rope fastening part 131.

In this case, since the sheet 100 is pulled by the connecting rope 130, edges of the entire shape of the tent may be formed.

In addition, as the connecting rope 130 further extends from the lower end of the tent and is coupled and fastened to a fixing-coupling means 300, the entire shape of the tent, which has a polyhedral shape, may be formed, and a position of the tent may be stably fixed.

An entrance 160 may be formed in the sheet 100 to allow the user to enter into the inner space S. For example, the entrance 160 may be defined in one surface the polyhedral shape of the tent.

The entrance 160, which is defined in one surface of the polyhedral shape formed by the sheet 100, may be variously provided so that the user may move between the inner space S and the outside.

The entrance 160, which is an opening defined in the sheet 100, may include: an entrance opening part 161 having a size for the user to enter therethrough; a mesh net (not shown) for blocking insects or the like from entering through the entrance opening part 161; an entrance cover member 163 covering the entrance opening part 161; and a detachable part 164 coupling the entrance cover member 163 to the sheet 100.

As the detachable part 164, which allows the entrance cover member 163 and the sheet 100 to be coupled to or detached from each other to open or cover the entrance opening part 161, may particularly include a fastener (e.g., VELCRO®) or a zipper.

Figure 9:
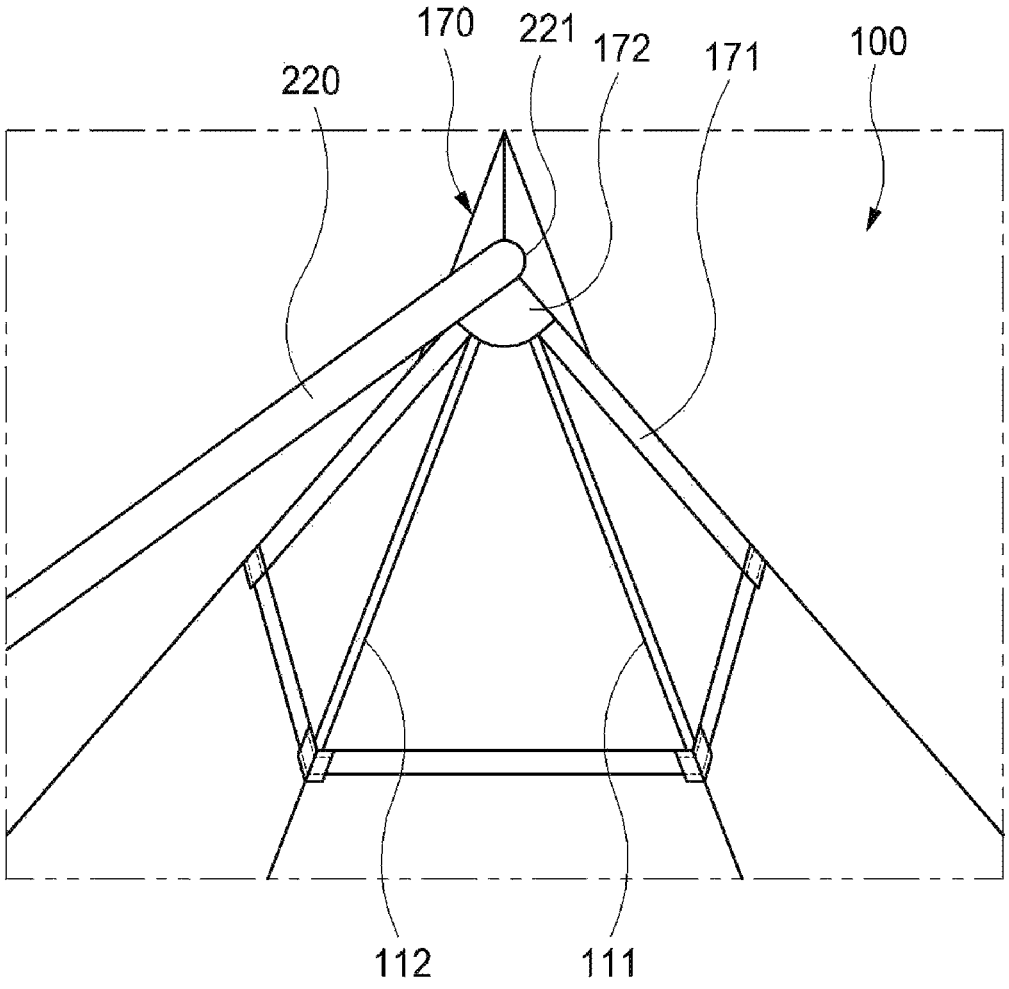
FIG. 9 is an enlarged view illustrating a state in which a supporting pole assembly supports an inside of a sheet in the tent of FIG. 1.
Figure 10:
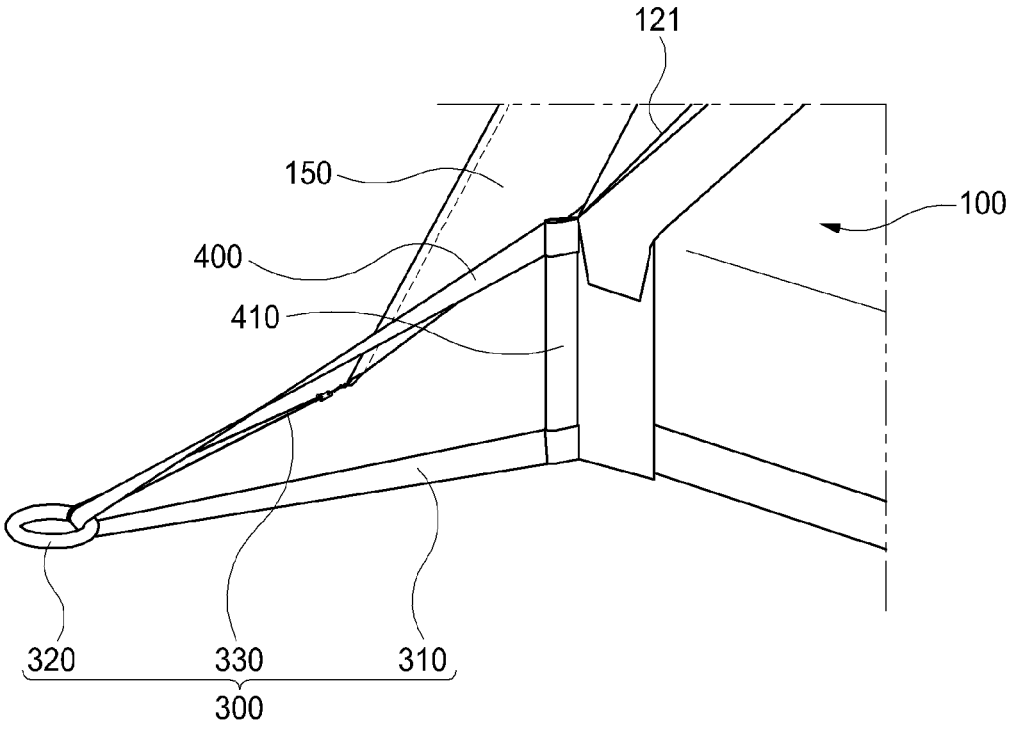
FIG. 10 is an enlarged view illustrating a fixing-coupling means of the tent of FIG. 1.

As illustrated in FIG. 9, the sheet 100 may include a support part 170 that is supported by the supporting pole assembly 200 that will be described later.

The support part 170, which is disposed on the inner ceiling portion of the sheet 100 and supported by the supporting pole assembly 200, may be variously provided with.

For example, the support part 170 may be made of a material that is intensified to be supported by the supporting pole assembly 200 at preset ceiling edges of the tent, which correspond to the two peaks P1, P2. Furthermore, as a groove having a size corresponding to the portion supported by the supporting pole assembly 200 that will be described later is defined, the support part 170 may be stably supported.

In this case, since the support part 170 is formed at the respective positions corresponding to the two peaks P1, P2 of the ceiling portion of the tent, and the supporting pole assembly 200, which will be described later, has a Y-shape to support the sheet 100 in an inclined manner instead of vertically supporting the sheet 100 with respect to the ground, a more stable support structure may be formed.

Also, an edge reinforcing part 171 extending from the edge of the venting opening 100, for example each peak P1, P2 to the inner space S may be formed near the support part 170 when forming the venting opening 110.

Also, the support part 170 may include a support pad 172 disposed on a portion directly contacting the supporting pole assembly 200 to enhance support stability.

The edge reinforcing part 171, which reinforces the edge of the venting opening 110 when the venting opening 110 is defined in the sheet 100, may be made of various materials and have various structures.

The edge reinforcing part 171 may be coupled to the support pad 172 to reinforce the edge of the venting opening 110.

In accordance with another embodiment, the support part 170 may include support members (not shown) corresponding to the support portions 221, 231 of the supporting pole assembly 200.

The support members (not shown) may be coupled to supported areas of the edge of the ceiling portion of the sheet 100. As the support portions 221, 231 of the supporting pole assembly 200 are inserted into the support members, respectively, the support members may stably support the sheet 100.

The support part 170 may be coupled to a support wire (not shown) connected to a support structure (not shown) that is separately installed on the ground to support the inside of the sheet 100.

Also, the sheet 100 may include a light shielding part 180 to increase tent space utilization of the user and block sunlight.

The light shielding part 180, which extends from the sheet 100 outside the tent to block the sunlight and form shade, may be variously provided with.

For example, the light shielding part 180 may include a light shielding sheet 181 overlapping the entrance 160 and a plurality of light shielding pins supporting the light shielding sheet 181 in order to install the light shielding part 180.

The light shielding sheet 181 may overlap a part of the sheet 100 when the light shielding part 180 is not used and be spread and supported by the plurality of light shielding pins 182 when the light shielding part 180 is used.

The supporting pole assembly 200 may include a main pole member 210 installed in an upward direction in the inner space S and a pair of branch pole members 220, 230 that are branched from the main pole member 210 to support the sheet 100, thereby forming the two peaks P1, P2 with respect to the sheet 100, so as to support the sheet 100 and form the inner space S having the two peaks P1, P2. The supporting pole assembly 200 may be variously provided with.

The main pole member 210 and the pair of the branch pole members 220, 230, which support the sheet 100 to form the two peaks P1, P2, may desirably have an entire shape of Y and be variously provided with in accordance with a structure in which the main pole member 210 and the pair of the branch pole members 220, 230 are integrated with or separated from each other.

The main pole member 210, which is installed upward in the inner space S, may have various shapes such as a rod shape extending upward from the ground in an elongated manner.

For example, the main pole member 210 may be made of various materials such as metal and FRP and have various structures such as hollow structure in accordance with a coupling structure that will be described later.

Also, the main pole member 210 may be installed in perpendicular to the ground in the inner space S, and desirably, be partially buried into the ground by a predetermined depth and installed at a central portion of the inner space S for stable support.

In accordance with another embodiment, the main pole member 210 may be installed on the ground in a contact manner. In this case, a ground contact portion may have a wider area for stable support.

Also, the main pole member 210 may have a predetermined height to increase the utilization space of the inner space S, and more desirably, be formed in an elongated manner within a range to have a coupling angle at which the sheet 100 is stably supported in consideration of the coupling angle of the pair of the branch pole members 220, 230.

The main pole member 210 may be made of light aluminum, alloy or FRP for better portable efficiency. Furthermore, the main pole member 210 may have at least one joint to adjust the length thereof.

The main pole member 210, which is adjustable in length, may be variously provided with.

For example, the main pole member 210, for example tapered pipe may have at least one joint, a groove and a protruding portion, which may fix an elongated length, may be provided with on the joint (not shown), and the elongated length may be fixed by inserting the protruding portion into the groove in a fixed manner such as a plurality of tapered pipes which connect with each other by insertion method.

On the contrary, as the protruding portion is pressed and separated from the groove, the joints may overlap each other, and thus the main pole member 210 may decrease in length and be easily carried out.

The pair of the branch pole members 220, 230, which are branched from the main pole member 210 to support the sheet 100 to form the two peaks P1, P2, may be variously provided with.

For example, the pair of the branch pole members 220, 230, which are integrated with the main pole member 210 or branched and extended through a coupling structure, may be made of various materials such as metal or FRP and have various structures such as a hollow structure in accordance with a coupling structure that will be described later.

The pair of the branch pole members 220, 230 may be made of the same aluminum, alloy or FRP as that of the main pole member 210 and be adjustable in length for better portable efficiency.

The pair of the branch pole members 220, 230 may support the sheet 100 as the support portions 221, 231 contacting the sheet 100 contact the above-described support part 170, and here, stably support the sheet 100 in correspondence to the shape of the support part 170.

For example, each of the pair of the branch pole members 220, 230 may have a diameter to be inserted when the support portions 221, 231 contacting the sheet 100 are installed in the support member.

In accordance with another embodiment, the pair of the branch pole members 220, 230 may have a shape in which a portion of an end thereof is bent in order to allow the tent to have the pair of the peaks P1, P2, increase, through this, the utilization space of the inner space S, and support the sheet 100 at an angle in perpendicular to the ground.

Also, the pair of the branch pole members 220, 230 may be variously provided in accordance with the structure in which the main pole member 210 and the pair of the branch pole members 220, 230 are integrated with or separated from each other.

As a specific example, the main pole member 210 and the pair of the branch pole members 220, 230 may be integrated with each other.

Figure 8A:
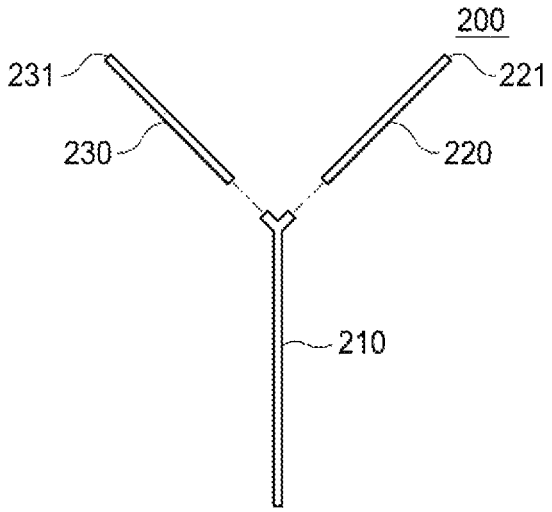
FIGS. 8A to 8C are view illustrating various embodiments of a supporting pole assembly in the tent of FIG. 1.

For another example, as illustrated in FIG. 8A, the main pole member 210 has a 'Y'-shaped ends that are branched from an end opposite to an end supported by the ground, and the ends may be coupled to the branch pole members 220, 230, respectively. Here, the pair of the branch pole members 220, 230 may be also integrated with each other.

Figure 8B:
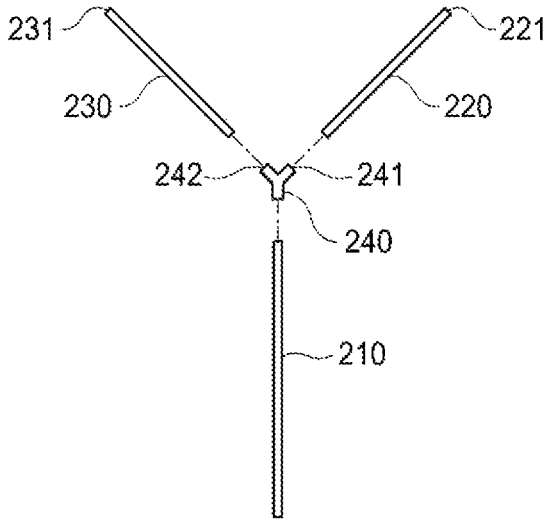
Figure 8C:
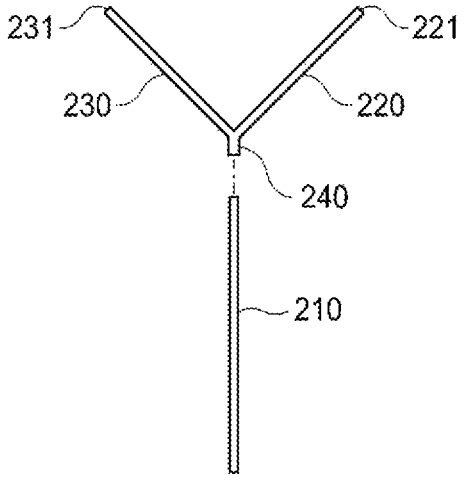

For another example, as illustrated in FIG. 8C in accordance with an embodiment, the pair of the branch pole members 220, 230 may be integrated with each other, and the integrated a pair of branch pole members 220, 230 may be coupled to the main pole member 210.

Here, the integrated structure of the pair of the branch pole members 220, 230 may have an entire shape of various structures such as a triangular structure.

The main pole member 210 and the branch pole members 220, 230 may be directly coupled to each other or indirectly coupled to each other through a separated connector.

For example, as illustrated in FIG. 8B, the supporting pole assembly 200 may include the main pole member 210 and a pair of branch pole members 220, 230, which are coupled through a connector 240, so as to have a coupling structure between the main pole member 210 and the pair of the branch pole members 220, 230.

The connector 240, which connects the main pole member 210 to the pair of the branch pole members 220, 230 to have the coupling structure between the main pole member 210 and the pair of the branch pole members 220, 230, may be variously provided with.

The connector 240, which determines an angle between the pair of the branch pole members 220, 230, may adjust an angle between the coupling portions 241 and 242 coupled to the pair of the branch pole members 220, 230 so that the pair of the branch pole members 220, 230 have various angles on the basis of the height of the main pole member 210.

As illustrated in FIG. 8A, the connector 240 may be integrated with the main pole member 210 and include the coupling portions 241, 242 that are inserted into the pair of the branch pole members 220, 230 in a coupled manner. In accordance with another embodiment, as illustrated in FIG.

8C, the connector 240 may be integrated with one branch pole members 220, 230, and the main pole member 210 may be inserted thereto.

In addition, as illustrated in FIG. 8B, the connector 240, as an independent component, may have three coupling portions, which are inserted into the main pole member 210 and the pair of the branch pole members 220, 230 in a coupled manner, respectively.

Also, the connector 240, which is coupled to the main pole member 210 and the pair of the branch pole members 220, 230 in a detachable manner, may be variously provided.

For example, for stable coupling between the main pole member 210 and the pair of the branch pole members 220, 230, as a protruding portion (not shown), which is provided on the end for coupling between the main pole member 210 and the pair of the branch pole members 220, 230, is inserted into an insertion hole (not shown), which has a size corresponding to the protruding portion, defined in the connector 240, the connector 240 may be stably coupled.

The tent in accordance with the present invention may include the fixing-coupling means 300 for forming the outer shape of the tent together with the sheet 100, and the fixing-coupling means 300 may be connected with a fixing structure installed at the outside of the tent and a vertex of a polygonal planar shape may be formed by the lower end of the sheet 100. Here the polygonal planar shape is horizontally formed by the lower end of the sheet 100. That is to say, the polygonal planar shape is defined by the horizontal projection of the lower end of the sheet 100.

When the lower end of the sheet 100 has a polygonal planar shape, the fixing-coupling means 300 is coupled to the other fixing structure in the vertex of the polygonal shape, to make and maintain the sheet the outer appearance of the tent. The fixing-coupling means 300 may be variously provided with.

For example, the fixing-coupling means 300 may include: a fixing-coupling rope 310 having one end coupled to the sheet 100 at the lower end of the sheet 100 among corners of the sheet 100 having the polyhedral shape and the other end coupled to the fixing structure installed at the outside to fix the position of the tent; and a coupling ring 320 coupled to an end of the fixing-coupling rope 310, thereby being coupled to the fixing structure.

The fixing-coupling rope 310, which connects the sheet 100 to the fixing structure, may be variously provided with.

The coupling ring 320, which allows the fixing-coupling rope 310 and the fixing structure to be easily coupled, may be variously provided with. For example, as the coupling ring 320 coupled to the fixing-coupling rope 310 is pulled to apply tension to the fixing-coupling rope 310, the corners of the sheet 100 having the polyhedral shape may be formed.

In addition, the coupling ring 320 may be fixed to the ground together with a pin member that is an example of the fixing structure. As the pin member passes through the coupling ring 320 and then is inserted into the ground by a predetermined depth, the tension may be applied to the fixing-coupling rope 310 to fix the position of the tent.

As another embodiment, the tent in accordance with the present invention may include a plurality of connecting units 400 respectively having one end coupled to the sheet 100 and the other end coupled to the fixing-coupling means 300 between the peaks P1, P2 and the fixing-coupling means 300 to form a triangular shape with the sheet 100 and the fixing-coupling means 300.

That is, a direct structure, in which the edges of the sheet 100 may be separated at a predetermined height and at a portion coupled to the connecting unit 400, and the sheet 100 extends downward, may be formed.

The connecting unit 400 has one end coupled to the sheet 100 and the other end coupled to the fixing-coupling means 300 at a predetermined height from the lower end of the sheet 100 to form a triangular shape with the sheet 100 and the fixing-coupling means 300. The connecting unit 400 may be variously provided with.

For example, as the connecting unit 400 has one end coupled to the sheet 100 and the other end coupled to the coupling ring 320 of the fixing-coupling means 300 so that a tension is applied thereto, the connecting unit 400 may have the direct structure from the position coupled to connecting unit 400 to the lower end of the sheet 100.

In this case, the connecting unit 400, the fixing-coupling means 300, and the sheet 100 may form the triangular shape.

The tent in accordance with the present invention may include a frame member 410 that is perpendicular to the ground between a position at which the connecting unit 400 is coupled to the sheet 100 and a position coupled to the fixing-coupling means 300.

The frame member 410 is installed on the sheet 100 having the direct structure while perpendicular to the ground, so that the edge of the sheet 100 forms the direct structure upto a predetermined height. The frame member 410 may be variously provided with.

The frame member 410 may be installed perpendicular to the ground between the position at which the connecting unit 400 is coupled to the sheet 100 and the position coupled to the fixing-coupling means 300, and more particularly, be coupled such that the fixing-coupling rope 310 is connected to the lower end of the frame member 410 in a state in which the frame member 410 is installed. Furthermore, the connecting unit 400 may be installed on an upper end of the frame member 410.

In this case, the connecting unit 400 and the fixing-coupling rope 310 may be coupled to the upper end and the lower end of the frame member 410, respectively, and be coupled together to the coupling ring 320, thereby maintaining the tension.

The sheet 100 may include a cover 150 further extending from the sheet 100 at a position at which the connecting unit 400 is installed with respect to the sheet 100 in which the edge has the direct structure.

As a string 330 having tension at an end thereof is installed, the cover 150 may extend from the sheet 100.

The string 330 may have one end coupled to an end of the cover 150 and the other end coupled to the coupling ring 320 to maintain tightness with the tension. Through this, the entire shape of the sheet 100 including the cover 150 may be maintained.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A tent comprising:

a sheet forming an inner space having two peaks; and a supporting pole assembly comprising a main pole member installed upward in the inner space and a pair of branch pole members branched from the main pole member to support the sheet, thereby forming the two peaks, wherein the sheet comprises two support parts supported by the corresponding branch pole member and a plurality of vertexes, each support part is formed with a groove having a size corresponding to a supporting portion of the corresponding branch pole member at a position corresponding to each peak of an inner ceiling edge of the sheet, the main pole member is installed perpendicular to a ground in the inner space, and each branch pole member supports the sheet in each peak at the end of the branch pole member, a lower end of the sheet supported by the supporting pole assembly forms polygonal shape, and each vertex of the polygonal shaped sheet is connected to a fixing structure installed at the outside of the tent by a fixing-coupling means, and wherein the fixing-coupling means comprises:

a coupling ring through which a pin member inserted into the ground passes, wherein the pin member is the fixing structure; and a fixing-coupling rope having one end coupled to the sheet at the lower end of the sheet and the other end coupled to the coupling ring to fix a position of the tent.

2. The tent of claim 1, further comprising a plurality of connecting units, each having one end coupled to the sheet near the sheet lower edge and the other end coupled to one of the fixing-coupling ropes, wherein each connecting unit forms a triangular shape together with a respective fixing-coupling rope, and a segment of sheet in between two points where the connecting unit and the fixing-coupling rope are attached to the sheet.

3. The tent of claim 2, wherein a frame member is further installed perpendicular to the ground along the segment of sheet in between the two points where one of the connecting units and one of the fixing-coupling ropes are attached to the sheet.

4. The tent of claim 1, wherein the sheet comprises at least one venting opening for ventilating the inner space of the tent, and each peak is positioned at the edge of the venting opening.

5. The tent of claim 4, further comprising a cover member for covering the venting opening.

6. The tent of claim 1, wherein the supporting pole assembly comprises a connector for connecting the main pole member to the pair of the branch pole members.

* * * * *